United States Patent [19]

Kushigian

[11] Patent Number: 4,559,919

[45] Date of Patent: Dec. 24, 1985

[54] GRINDING WHEEL PROFILER

[76] Inventor: Anthony Kushigian, P.O. Box 768, Hendersonville, N.C. 28739

[21] Appl. No.: 568,211

[22] Filed: Dec. 15, 1983

[51] Int. Cl.[4] ..... B24B 53/06

[52] U.S. Cl. ..... 125/11 R; 125/11 CD; 51/165.71

[58] Field of Search ..... 125/11 R, 11 PH, 11 CD, 125/11 H; 51/165.71, 165 TP

[56] References Cited

U.S. PATENT DOCUMENTS

| | | | |
|---|---|---|---|
| 2,449,372 | 9/1948 | Eglinton | 51/100 R |
| 2,778,353 | 1/1957 | Carlsen | 125/11 PH |
| 2,907,315 | 10/1959 | Hill | 125/11 PH |
| 3,490,430 | 1/1970 | Hoglund | 125/11 R |
| 3,906,677 | 9/1975 | Gunter | 51/165.71 |
| 4,103,668 | 8/1978 | Nishimura | 51/165.71 |
| 4,274,231 | 6/1981 | Verega | 125/11 CD |

*Primary Examiner*—Harold D. Whitehead

*Attorney, Agent, or Firm*—Barnes, Kisselle, Raisch, Choate, Whittemore & Hulbert

[57] ABSTRACT

A profiler for moving a dresser into and across a rotating grinding wheel to form or dress a predetermined configuration in the grinding wheel for use in grinding workpieces. The dresser is moved along two axes at a right angle to each other by lead screws connected to slides and driven by servomotors. The servomotors are actuated and controlled to move the dresser along a desired path by a computer control unit with appropriate software and programming to produce or dress a predetermined configuration in the rotating grinding wheel. To prevent contaminants from destroying the drive mechanism and the ways for the slides, they are completely enclosed while still permitting easy assembly and disassembly of the computer parts of the profiler.

7 Claims, 8 Drawing Figures

GRINDING WHEEL PROFILER

This invention relates to the grinding of workpieces and more paticularly to the forming of a complex profile or configuration on a grinding wheel for grinding a complex shape in a workpiece.

Previously complex and/or highly accurate profiles have been formed in grinding wheels by skilled tradesmen. Usually the skilled tradesmen use a variety of single point dressers to form the profile in a grinding wheel. Typically the dressers are mounted on a slide which can be manually moved with respect to the rotating grinding wheel to form the profile.

The profile of this invention moves a dresser with respect to the grinding wheel along a first axis which is parallel to the axis of rotation of the grinding wheel and along a second axis which is at generally a right angle to the first axis. The dresser is moved along each axis by servomechanisms controlled by a computer and suitable software which permits the movement of the dresser to be programmed to produce a predetermined desired profile. Preferably, the dresser can be either single or multiple wheels or points. To prevent abrasive particles, dust, grit, and airborne contaminants from damaging the profiler, its drive mechanism and ways are toally enclosed and sealed from the atmosphere while still permitting the profiler to be readily assembled or disassembled.

Objects, features, and advantages of this invention are to provide a profiler which produces complex configurations on grinding wheels rapidly, easily, economically and with greatly improved accuracy and which is a sealed unit preventing damage from abrasive particles and airborne contaminates, readily adaptable to single and multiple wheel and point dressers, lightweight, compact, easily and rapidly programmed, and easily and economically manufactured, assembled and serviced, and which has a long in service life and requires little maintenance and service.

These and other objects, features and advantages of this invention will be apparent from the following detailed description, appended claims and accompany drawings in which:

Figure 1:
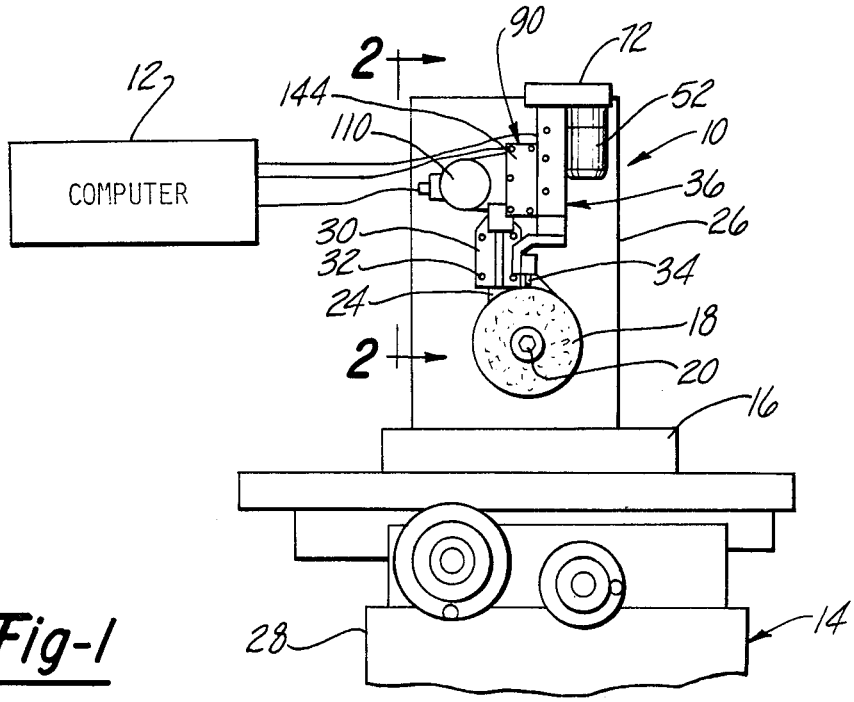
FIG. 1 is a side view of a profiler embodying this invention mounted on a grinding machine.

Referring to more detail to the drawings, FIG. 1 illustrates a profiler 10 embodying this invention which is cycled by a computer numerical controller 12 with a suitable computer program and programming. The profiler 10 is mounted on a grinding machine 14 with a work table 16 which reciprocates under a grinding wheel 18 secured to a spindle 20. The spindle is journaled for rotation in a housing 22 carried by a slide 24 for moving the grinding wheel generally vertically toward and away from a workpiece received on the table. The spindle slide is carried by ways secured to a vertical support 26 fixed to the base 28 of the grinding machine. The profiler 10 is also mounted on the spindle slide by a support bracket 30 and cap screws 32.

Both to initially form a predetermined configuration or profile in a grinding wheel and/or to dress a predetermined configuration already in a grinding wheel, the profiler 10 moves a dresser 34 into and across the rotating grinding wheel. In accordance with this invention the profiler moves a dresser along two axes which are at a right angle to each other. Preferably one axis (hereinafter sometimes referred to as the "X" axis) is parallel to the axis of rotation of the grinding wheel and the other axis (hereinafter sometimes referred to as the "Y" axis) is parallel to a radius of the grinding wheel. When profiler 10 is mounted on the grinding machine, preferably the X axis extends generally horizontally and the Y axis extends generally vertically.

The dresser is moved along the Y axis by a slide 36 which is mounted by a pair of antifriction roller ways 38 on a carrier member 40. One rail of each way 38 is secured by cap screws to the slide and the other rail of each way is secured by cap screws to the carrier member. The slide 36 is reciprocated by an antifriction lead screw 42 and a complimentary nut 44 secured by a retainer plate 46 and cap screws 48 in a counterbore 50 in the carrier member 40.

The lead screw is driven by a direct current (DC) servomotor 52 coupled to the lead screw by a timing belt 54 and pulleys 56 and 58. The lead screw and servomotor are mounted on the slide for movement therewith by an end plate 60 secured to the slide by cap screws (not shown). To permit adjustment of the tension on the belt 54, the servomotor 52 is mounted on the end plate 60 by cap screws 62 received in elongate slots 64 in the plate. The lead screw 42 is journaled for rotation by a ball bearing assembly 66 received in counterbore 68 in the end plate and secured therein by cap screws 70.

In accordance with this invention, to prevent contaminants from entering the profiler, a cover 72 and the servomotor 52 are sealed to the end plate 60. The servomotor is sealed by engagement of its flat mounting face 74 with a complimentary flat face 76 on the end plate. The cover 72 is secured by screws 78 threaded into blocks 80 fastened by cap screws 82 to the end plate. The bottom of the slide 36 is closed and sealed by an end plate 84 secured to the slide by cap screws (not shown).

The dresser is moved along the X axis by a slide 86 which is mounted by a pair of antifriction roller ways 88 in a housing 90 secured by cap screws 92 to the support bracket 30. One rail of each roller way 88 is secured to the slide 86 by cap screws 94 and the other rail of each way is secured to the housing 90 by cap screws 96. The slide is reciprocated by an antifriction lead screw 98 and a complimentary nut 100 which is received and retained in a counterbore 102 in the slide by a retainer plate 104 and cap screws (not shown). Rotation of the nut 98 in the slide is prevented by a key 106 and a set screw 108.

The lead screw 98 is driven by a DC servomotor 110 coupled to the lead screw by a timing belt 112 and pulleys 114 and 116. The lead screw and motor are mounted on the housing 90 by a mounting plate 118 secured to one end of the housing by cap screws (not shown). The lead screw is journaled for rotation by a bearing assembly 120 received and retained in a counterbore 122 in the plate by a retaining washer 124 and cap screws 126. To permit adjustment of the tension on the belt 112, the motor 110 is secured to the mounting plate 118 by cap screws 128 received in elongate slots 130 in the plate.

To prevent contaminants from entering the profiler, a cover 132 and the motor 110 are in sealing engagement with the mounting plate 118. The motor is sealed by engagement of its flat mounting face 134 with a complimentary flat face 136 on the mounting plate. The cover is secured to the plate by screws 138 threaded into blocks 140 secured by cap screws 141 to the mounting plate. The bearing assembly 120 is also protected by a seal 142 carried by the mounting plate 118. At the other end, the housing 90 is closed and sealed by an end plate 144 secured by cap screws 146.

In accordance with another feature of this invention, the ways and the entire drive mechanism for the slides are totally enclosed and sealed from the exterior of the profiler to prevent their contamination. The housing 90 and the slide 36 are sealed together while permitting both the slides 36 and 86 to move with respect to the housing by three overlapped plates 148, 150, and 152. Each plate is flat, generally rectangular, and has a generally rectangular clearance aperture 154, 156, and 158 respectively therethrough. Plate 148 is secured to the housing 90 by screws 160 and has a flat side face which overlaps and is in sealing engagement with a complimentary flat face of plate 150. Plate 150 is received on rectangular prominences 162 and 164 of and entrapped between carrier 40 and slide 86. Plate 152 is secured by screws (not shown) to slide 36 and has a flat side face which overlaps and is in sealing engagement with a complimentary flat face of the plate 150. The sealing plates in conjunction with the dust covers 72 and 132 and the mounting of the motors 52 and 110 totally encloses and seals from contaminants the ways and drive mechanisms for the slides. When the seal plates become worn out by use of the profiler, they can be readily and inexpensively replaced.

In accordance with a further feature of this invention, the major components of the profiler are constructed and arranged so that they can be readily assembled and disassembled even though the ways and dive components of the slides are sealed to protect them from contamination. The various components are subassembled to their associated slide 36 or associated housing 90 and then the two subassemblies are secured together.

Figure 3:
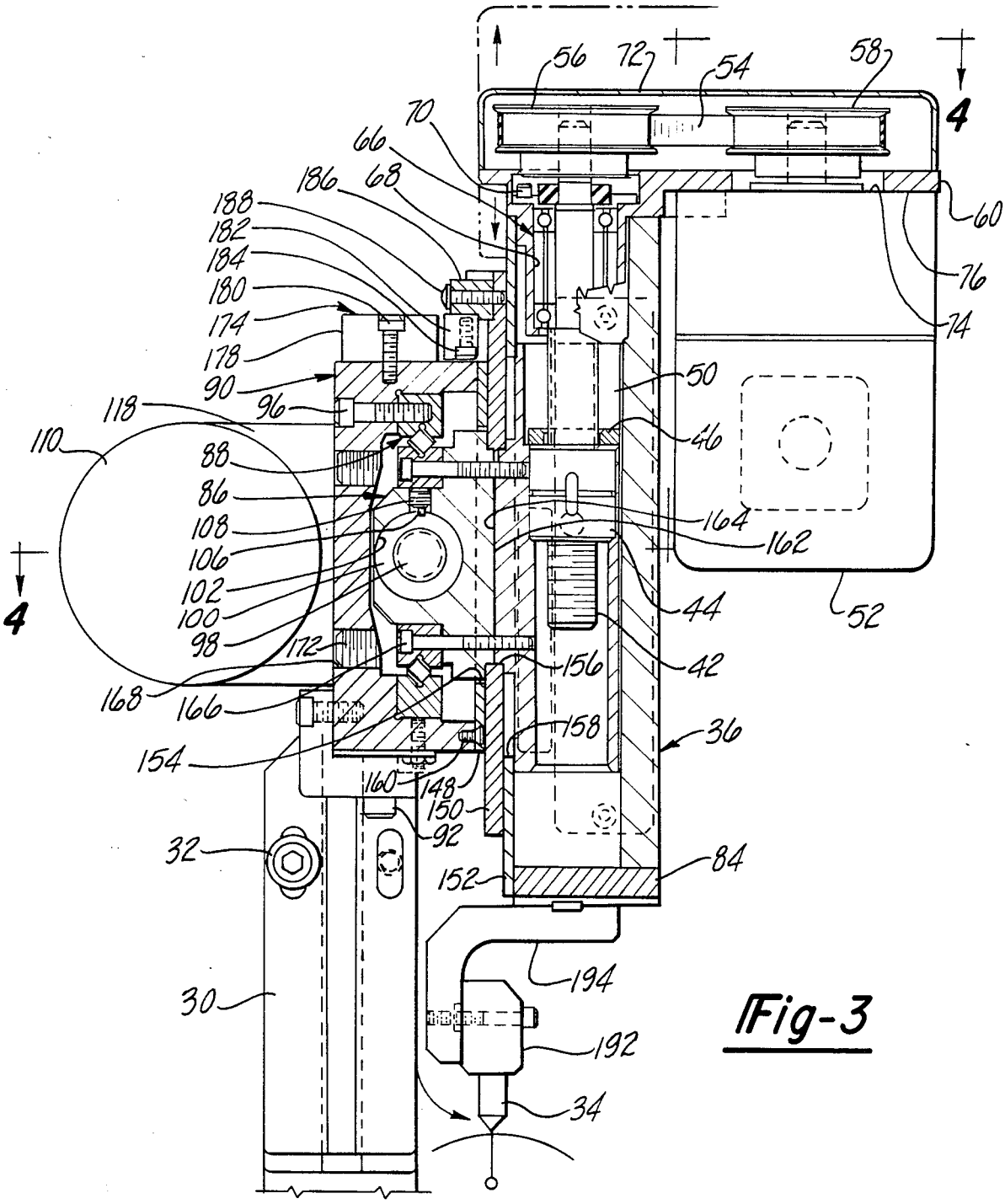
FIG. 3 is an enlarged sectional view taken generally on line 3—3 of FIG. 2.
Figure 4:
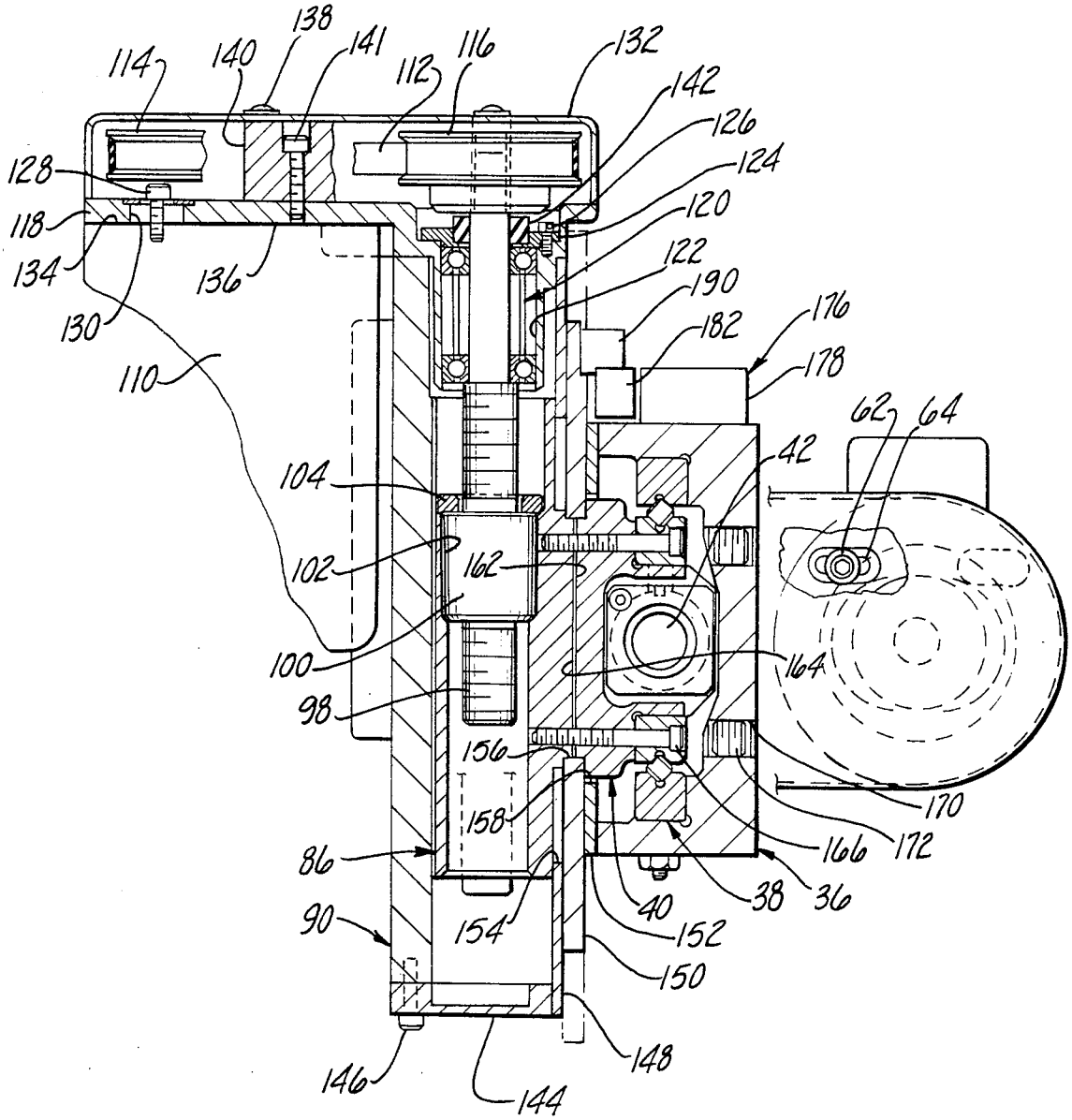
FIG. 4 is a fragmentary sectional view taken generally on line 4—4 of FIG. 3.

For example, the ways 38, carrier 40, lead screw 42, nut 44, motor 52, end plated 46, 60, seal plate 152, and related components can be subassembled to the slide 36. Similarly, the slide 86, ways 88, lead screw 98, nut 100, motor 110, end plates 118, 144, seal plate 148, and related components can be subassembled to the housing 90. Thereafter the two subassemblies can be secured together with the seal plate 150 received between the carrier 40 and the slide 86. As shown in FIG. 3 & 4, the slide and carrier are secured together in assembled relation by four cap screws 166. Two of the cap screws 166 extend through aligned holes in the rails of the ways 88 and the slide 86 and are threaded into the carrier 40. The other two cap screws 166 extend through aligned holes in the rails of the ways 38 and the carrier 40 and are threaded into the slide 86. Openings for inserting and removing these cap screws are provided by threaded holes 168 and 170 in the housing 90 and the slide 36 respectively. To prevent contaminants from entering the profiler through these holes, threaded plugs 172 are removably received therein.

In accordance with this invention, the computer numerical controller 12 with a suitable program or software and programming, actuates and controls servomotors 52 and 110 to cause the profiler to form or dress a predetermined configuration or profile in a grinding wheel. The computer may be an analog or preferably a digital computer. A suitable digital computer 12, CRT display, keyboard, and programs are commercially available from Elron Technologies, Inc. of New York, N.Y. 10019 under the tradename Conlog Numericon 850.

The computer actuates and controls the servomotors through servoloops or circuits utilizing sensor assemblies 174 and 176 each producing an electric signal indicating the position of the dresser on the X axis and Y axis respectively. Suitable sensors are commercially available from Heidenhain Corp. of Elk Grove Village, Ill. 60007 as Heidenhain Linear Scale LS903 sensors. This is an electro-optical sensor having a light source and an optical reader producing an electric signal indicating the position of reader and scale components of the sensor to each other.

An electric signal indicating the position of the dresser on the X axis is produced by the sensor 174 which has, as shown in FIG. 3, a reader 178 secured by cap screws 180 to the housing 90 and a scale 182 carried by the slide 86. The scale 182 is secured by cap screws 184 to a mounting block 186 secured by cap screws 188 to the center seal plate 150 carried by the slide 86. Similarly, an electric signal indicating the position on the Y axis of the dresser is produced by the sensor 176 which has, as shown in FIG. 4, a reader 178 secured to the slide 36 and an associated scale 182 secured to a mounting block 190 fixed to the center seal plate 150.

Figure 5:
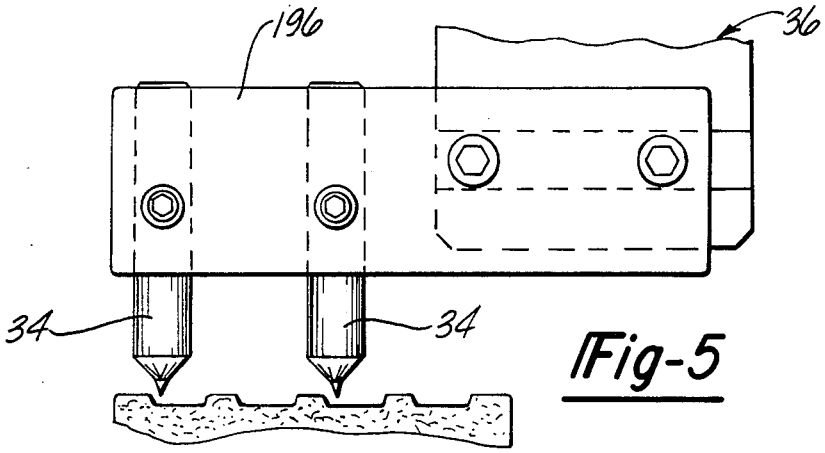
FIGS. 5 & 6 are fragmentary side views of single point dressers mounted on a slide of the profiler of FIG. 1.
Figure 6:
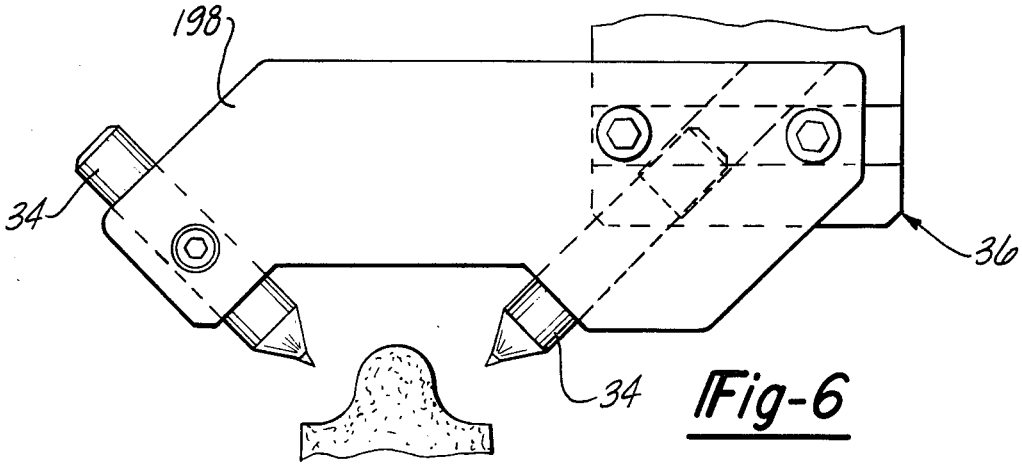
Figure 2:
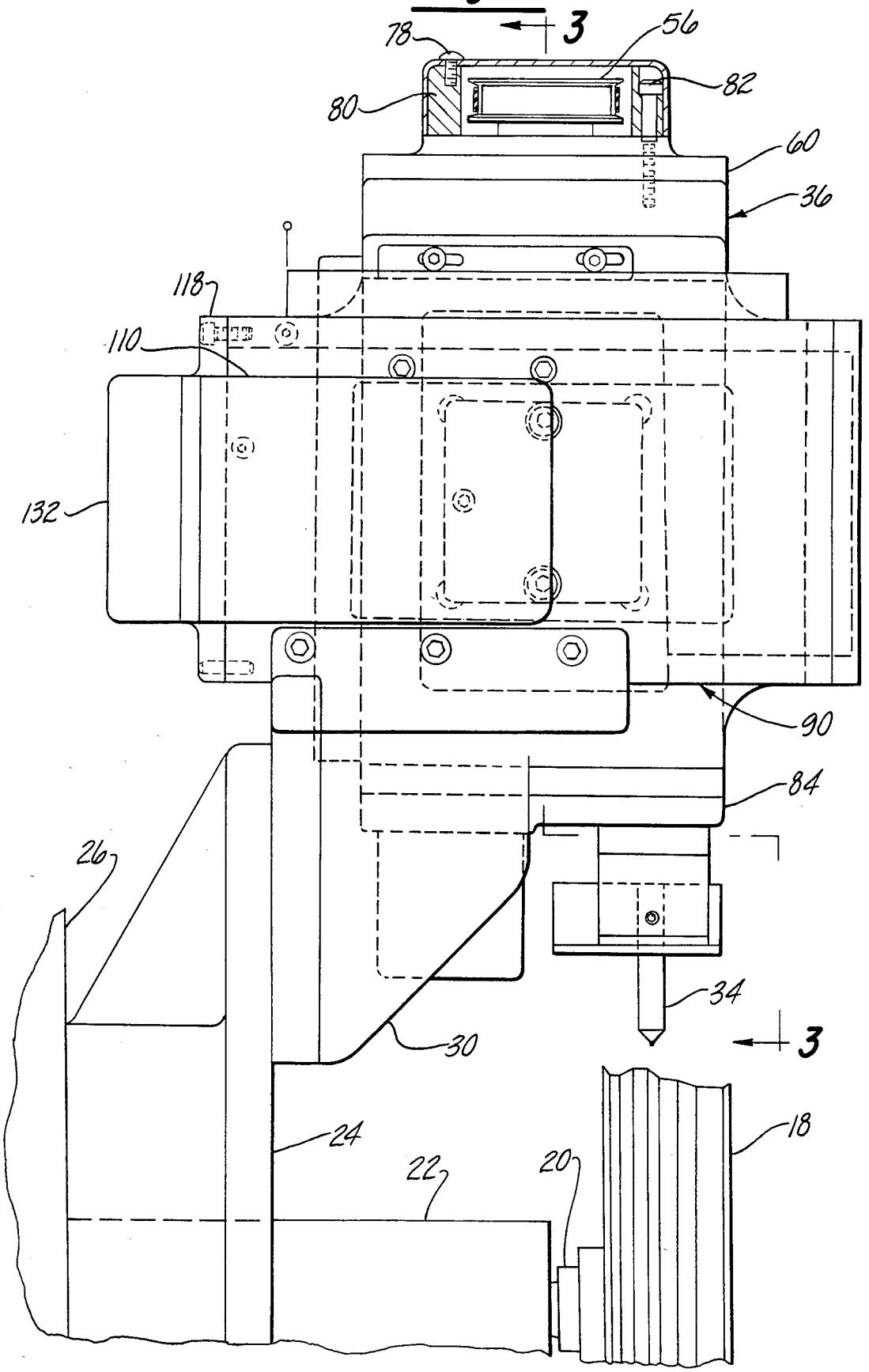
FIG. 2 is an enlarged and fragmentary end view of the profiler of FIG. 1.

For some applications, profiler 10 will be used with only one diamond tipped single point dresser 34 mounted on the slide 36. As shown in FIG. 3, dresser 34 is mounted on the slide 36 by a holder 192 secured by a cap screw to a bracket 194 fastened to the side. Where it is desirable to simultaneously form essentially identical profiles in either two seperate grinding wheels or one grinding wheel, as shown in FIG. 5, two single point dressers 34 can be positioned parallel to and spaced apart from each other in a holder 196 secured by cap screws to the slide 36. When forming profiles to produce deep grooves or recesses in a workpiece, as shown in FIG. 6, two single point dressers 34 can be inclined towards and spaced from each other in a holder 198 secured by cap screws to the slide 36.

Figure 7:
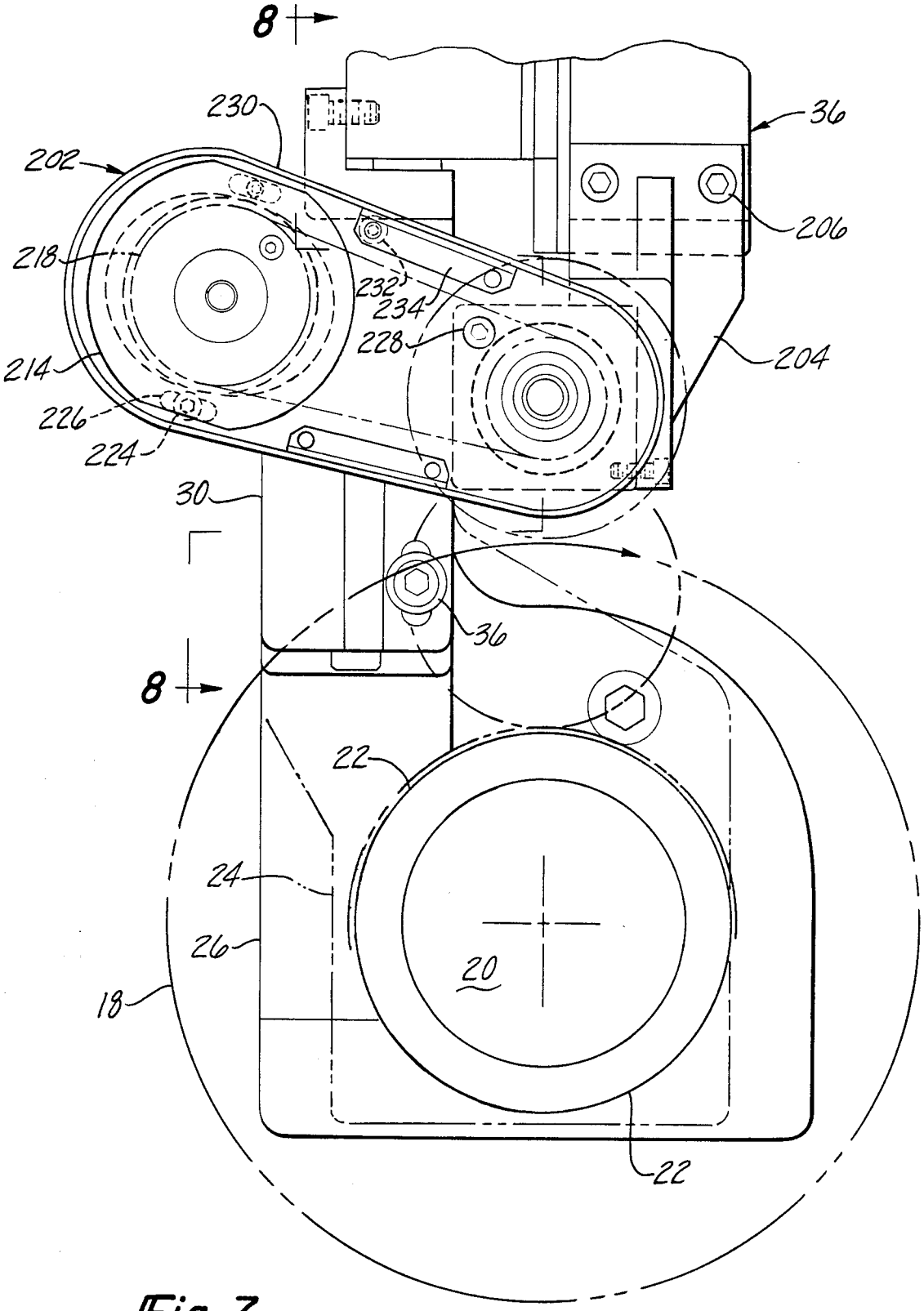
FIG. 7 is a fragmentary and enlarged side view of the profiler and grinding machine of FIG. 1 with dressing wheels mounted on a slide of the profiler.
Figure 8:
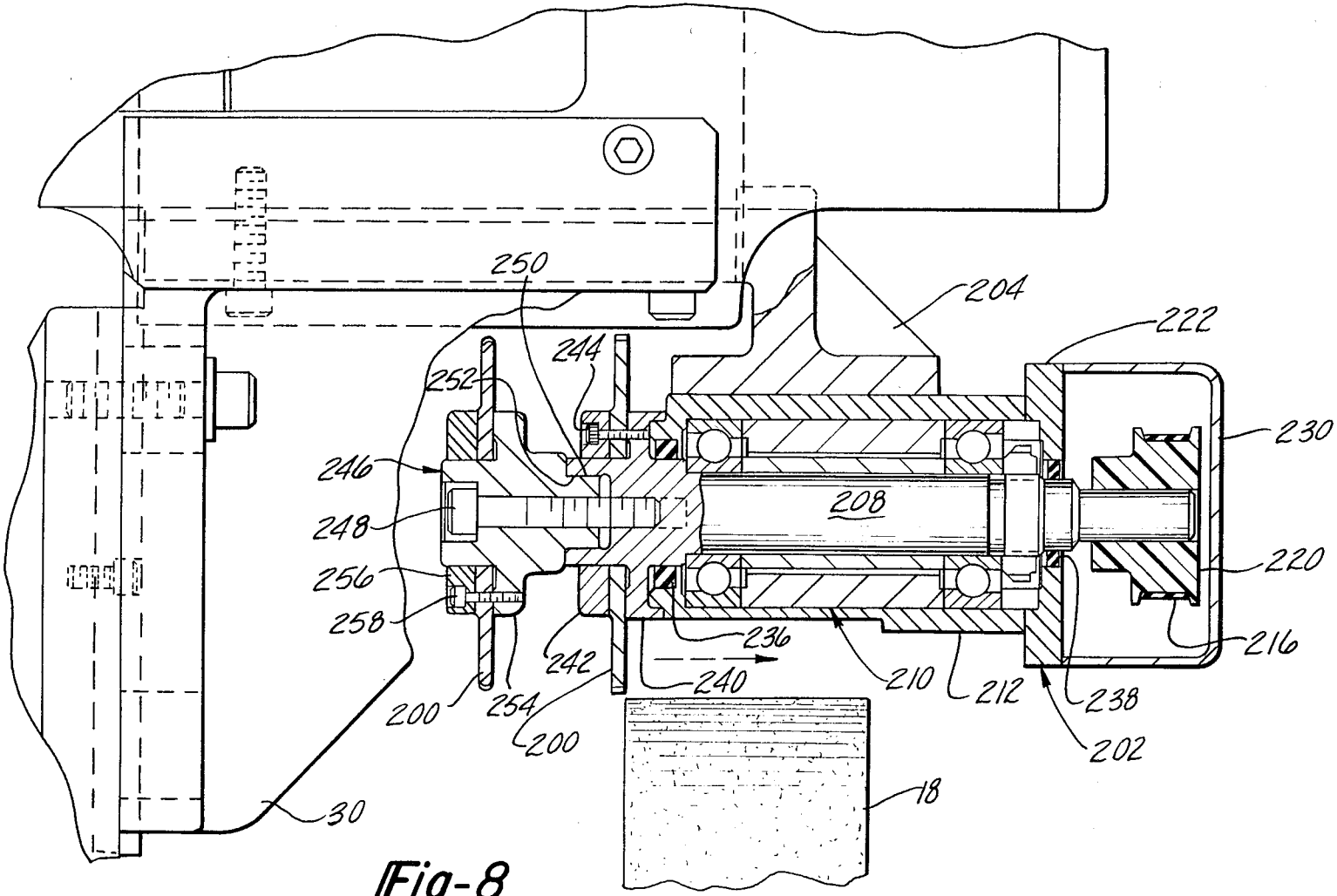
FIG. 8 is a fragmentary sectional view taken generally on line 8—8 of FIG. 7.

In other applications, it is desirable to use one or two rotating dresser wheels 200 mounted on the profiler to form or dress a configuration in a grinding wheel. As shown in FIGS. 7 and 8, a suitable dresser wheel assembly 202 can be mounted by a bracket 204 and cap screws 206 on the slide 36 of the profiler. The forming or dresser wheels 200 are mounted on an arbor 208 which is journaled for rotation by a bearing assembly 210 in a housing 212 secured by cap screws to the mounting bracket 204. The dresser wheels are rotated by a drive motor 214 coupled to the arbor by a belt 216 and pulleys 218 and 220. To permit adjustment of the tension on the belt 216, the motor is secured to a mounting plate 222 by cap screws 224 received in longate slots 226. The mounting plate is secured to one end of the housing 212 by cap screws 228. To prevent contaminants from entering the housing, a cover 230 encloses the belts and pulleys and is secured in sealed relation with the mounting plate by cap screws 232 and retainer blocks 234 fixed to the cover. Seals 236 and 238 are also provided adjacent opposite ends of the bearing assembly.

In accordance with another feature of the invention, either one or two forming or dresser wheels 200 can be mounted on the arbor 208. As shown in FIG. 8, the first dresser wheel is removably mounted between a flange 240 on the arbor and a retainer washer 242 secured to the flange by through cap screws 244. When desired, a second dresser wheel 200 carried by a hub 246 can be mounted on the arbor by a cap screw 248. To center the hub on the arbor it has a cylinderical pilot portion 250 which is slidably received in a bore 252 in the end of the arbor and is concentric with the axis of rotation of the arbor. The second grinding wheel is removably mounted between a flange 254 on the hub and a retainer washer 256 by through cap screws 258.

To use the profiler 10, it is typically mounted on a grinding machine 14 as shown in FIG. 1 so that it can move a dresser into contact with a grinding wheel 18 mounted on the spindle 20 of the grinding machine. The computer control unit 12, the servomotors 52 and 110, and the position sensors 174 and 176 are electrically interconnected through suitable cables and any needed interfaces (not shown). A suitable program is loaded into the computer unit to permit entry or programming of a predetermined desired configuration of the form to be produced or dressed in the grinding wheel. The data for the desired predetermined configuration is them programmed or entered into the computer control unit. When desired and on command the computer will actuate and control the DC servomotors to cause the profiler to move the dresser along the X and Y axes while the grinding wheel is rotating to form or dress the desired predetermined configuration in the grinding wheel.

The dresser is moved along the X axis by energizing the DC servomotor 52 which rotates the lead screw 42 to traverse the slide 36 and hence the dresser. Within predetermined limits, the dresser may be moved along the X axis in either direction depending on whether the DC servomotor 52 is rotated clockwise or counterclockwise by the computer control unit. As the dresser moves along the X axis, its position is sensed by the sensor assembly 174 which through appropriate servo and feedback electric circuitry (not shown) stops rotation of the servomotor 52 when the dresser reaches the desired position on the X axis established by the computer control unit, program, and programming.

Similarly, the dresser is moved along the Y axis by the computer control unit energizing the DC servomotor 110 which rotates the lead screw 98 to traverse the slide 86 and hence the dresser. Within predetermined limits, the dresser may be moved in either direction along the Y axis depending on whether the DC servomotor 100 is rotated clockwise or counterclockwise by the computer control unit. As the dresser moves along the Y axis, its position is sensed by the sensor assembly 176 which through appropriate servo and feedback electric circuitry (not shown) stops the motor when the dresser reaches the desired position on the Y axis established by the computer control unit, program, and programming. In many instances, the computer control unit will move the dresser along both the X and Y axes simultaneously in order to move the dresser along the path necessary to produce the desired predetermined configuration in the grinding wheel.

I claim:

1. A grinding wheel profiler apparatus comprising a housing, a first slide received within and carried by said housing for movement with respect to said housing along a first axis, a first lead screw within said housing and connected to one of said housing and first slide, a first nut engaging said first lead screw and connected with the other of said housing and first slide, at least two antifriction first ways each having first and second rails with said first rails connected to said first slide and said second rails connected to said housing, a carrier member carried by said first slide, a second slide carried by said carrier member for movement with respect to said first slide along a second axis essentially transverse to said first axis, a second lead screw received within said second slide and connected with one of said carrier member and second slide, a second nut engaging said second lead screw and connected with the other of said carrier member and second slide, at least two antifriction second ways each having first and second rails with said first rails connected to said second slide and said second rails connected to said carrier member, fasteners releasably securing together said first slide and said carrier member, passages through at least one of said housing and said second slide through which said fasteners can be inserted and removed, and plugs removably received in said passages to seal said passages when said plugs are received therein, a first seal plate carried by said housing and having a flat face constructed and arranged to bear on a complimentary flat face of a second seal plate carried by said first slide, said first seal plate having an aperture therethrough the perimeter of which encircles and first slide while permitting it to move along said first axis, a second seal plate carried by said first slide and having a flat face complimentary to, bearing on, and overlapped with said flat face of said first seal plate througout the extent of movement of said first slide along said first axis and a second flat face constructed and arranged to bear on a complimentary flat face of a third seal plate, a third seal plate carried by said second slide and having an aperture therethrough and a flat face complimentary to, bearing on, and overlapped with said second face of said second seal plate throughout the extend of movement of said second slide along said second axis, and said housing, seal plates and slides are constructed and arranged such that the various components associated with said first slide and housing can be subassembled thereto, the various components associated with said second slide and carrier member can be subassembled thereto, said subassemblies can be releasably assembled together by said fasteners, and when assembled together said housing, seal plates and second slide provide an enclosure of said lead screws, nuts, ways and first slide and prevent contaminants from entering the enclosure while permitting both of said slides to move with respect to said housing.

2. The profiler of claim 1 which also comprises a first servomotor carried by said housing and coupled with one of said first lead screw and associated first nut to produce relative rotation therebetween when said first servomotor is energized, a first cover enclosing said coupling of said first servomotor and sealing said first lead screw from contaminants passing around said coupling, a second servomotor carried by said second slide and coupled with one of said second lead screw and associated second nut to produce relative rotation therebetween when said second servomotor is energized, and a second cover enclosing said coupling and sealing said second lead screw from contaminants passing around said second coupling.

3. The profiler of claim 1 which also comprises a first servomotor carried by said housing and coupled with one of said first lead screw and associated first nut to produce relative rotation therebetween when energized, a second servomotor carried by said second slide and coupled with one of said second lead screw and associated second nut to produce relative rotation therebetween when energized, a first sensor associated with said housing and said first slide to provide an electric signal indicative of the position of said first slide on said first axis, a second sensor associated with said second slide and said first slide to provide an electric signal indicative of the position of said second slide on said second axis, a programmable computer, and control circuits electrically interfaced with said computer, said sensors, and said servomotors and constructed and arranged to energize said servomotors to move along said first and second axes a dresser carried by said second slide to produce a profile in a grinding wheel having a predetermined configuration programmed into said computer.

4. The profiler of claim 1 which also comprises a first mounting plate carried by said housing and having an aperture therethrough, a first servomotor secured to said first mounting plate and having a drive shaft extending through said aperture in said first mounting plate and a mounting face sealed with a complimentary face on said first mounting plate, a coupling connecting said first servomotor with one of said first lead screw and associated first nut for relative rotation therebetween when said first servomotor is energized, a first cover enclosing said coupling and sealed to said frist mounting plate to prevent contamination of said first lead screw by contaminants passing around said frist coupling, a second mounting plate carried by said second slide and having an aperture therethrough, a second servomotor secured to said second mounting plate and having a drive shaft projecting through said aperture in said second mounting plate and a mounting face sealed to a complimentary face on said second plate, a second coupling connecting said second motor and one of said second lead screw and associated second nut for relative rotation therebetween by said second servomotor when energized, and a second cover enclosing said second coupling and sealed to said second mounting plate to prevent contamination of said second lead screw by contaminants passing around said second coupling.

5. The profiler of claim 4 wherein said first coupling comprises a first belt connecting said first motor with one of said first lead screw and associated first nut, said second coupling comprises a second belt connecting said second motor with one of said second lead screw and associated second nut, and which also comprises a first fastener releasably securing said first motor to said first mounting plate and constructed and arranged such that said first motor can be moved relative to said first mounting plate to adjust the tension on said first belt, and a second fastener releasably securing said second motor to said second mounting plate and constructred and arranged such that said second motor can be moved relative to said second mounting plate to adjust the tension on said second belt.

6. The profiler of claim 1 which also comprises an arbor carried by said second slide, a hub releasably secured to one end of said arbor in coaxial relation with the axis of rotation of said arbor, a complimentary pilot and recess each on one of said hub and arbor for coaxially aligining said hub with said arbor, a fastener releasably securing said hub to said arbor, a flange on said hub constructed and arranged to bear on a side face of a dresser wheel, a washer to bear on the other side face of the dresser wheel, and a fastener urging said washer and flange into firm engagement with the dresser wheel to mount the dresser wheel on said hub.

7. The profiler of claim 6 which also comprises a mounting on said arbor constructed and arranged to releasably retain another dresser wheel thereon for rotation therewith.

* * * * *

UNITED STATES PATENT AND TRADEMARK OFFICE

CERTIFICATE OF CORRECTION

PATENT NO. : 4,559,919
DATED : Dec. 24, 1985
INVENTOR(S) : Anthony Kushigian

It is certified that error appears in the above-identified patent and that said Letters Patent are hereby corrected as shown below:

At claim 1, column 6, line 33, delete "and" and insert -- said --

Signed and Sealed this

*Fourth* Day of *March 1986*

[SEAL]

*Attest:*

DONALD J. QUIGG

*Attesting Officer*

*Commissioner of Patents and Trademarks*